United States Patent [19]

Witchey et al.

[11] Patent Number: 4,625,988

[45] Date of Patent: Dec. 2, 1986

[54] QUICK HITCH AND METHOD OF USING SAME

[75] Inventors: Reinhold D. Witchey, Waterloo; James M. Green, Waverly, both of Iowa

[73] Assignee: Henke Manufacturing Corporation, Waverly, Iowa

[21] Appl. No.: 563,185

[22] Filed: Dec. 19, 1983

[51] Int. Cl.[4] ..... B60D 7/00

[52] U.S. Cl. ..... 280/461 A; 37/231; 37/272; 172/273

[58] Field of Search ..... 280/461 A, 504, 415 R, 280/415 A, 456 A, 460 A, 479 R, 479 A; 414/145 A, 686, 722–724; 172/272–275; 37/231, 272; 403/322, 330

[56] References Cited

U.S. PATENT DOCUMENTS

| | | | |
|---|---|---|---|
| 3,343,850 | 9/1967 | Stauss et al. | 280/504 |
| 3,760,883 | 9/1973 | Birk | 280/479 R |
| 3,876,091 | 4/1975 | MacDonald | 280/479 R |
| 4,068,959 | 1/1978 | Pemberton | 403/15 |
| 4,236,329 | 12/1980 | Hetrick | 280/479 R |
| 4,242,034 | 12/1980 | Schmitz | 414/723 |
| 4,243,356 | 0/1981 | Takojima | 414/723 |

*Primary Examiner*—John J. Love
*Assistant Examiner*—Eric D. Culbreth
*Attorney, Agent, or Firm*—Zarley, McKee, Thomte, Voorhees & Sease

[57] ABSTRACT

The present invention provides a quick hitch for connecting a prime mover to an implement to be used with the prime mover. The prime mover has a male assembly which can be quickly and easily hitched and unhitched to the female assembly of the implement. The male and female assemblies matingly receive one another and a locking mechanism on the female assembly maintains the two assemblies in a locked relationship. The prime mover is driven towards said implement until said male and female assemblies matingly engage one another, thereby engaging the locking mechanism and hitching the implement to the prime mover. To unhitch the male and female assemblies, the locking mechanism is moved to the unlocked position and the prime mover is driven away from the implement.

14 Claims, 9 Drawing Figures

QUICK HITCH AND METHOD OF USING SAME

BACKGROUND OF THE INVENTION

Hitches are necessary to enable implements such as snow plows and buckets to be attached and detached from prime movers such as road graders, end loaders, heavy duty trucks, and other heavy equipment tractors. It is desirable to attach and detach the implement to the prime mover as quickly as possible, however, prior art hitches generally have required pins or hydraulic systems which must be actuated or placed in position to insure that the implement is securely locked to the prime mover. The additional time required to place the pins in position or to actuate the hydraulic systems is undesirable.

Therefore, a primary objective of the present invention is the provision of a hitch which enables an operator to quickly attach and detach an implement to a prime mover.

A further objective of the present invention is the provision of a quick hitch which securely locks the implement to the prime mover without the use of pins or hydraulics.

A still further objective of the present invention is the provision of a quick hitch which easily aligns the implement with the prime mover.

A further objective of the present invention is the provision of a method for quickly hitching and unhitching an implement to and from a prime mover.

A further objective of the present invention is the provision of a quick hitch which is durable and safe in use and economic to manufacture.

SUMMARY OF THE INVENTION

The quick hitch assembly of the present invention for attaching an implement to a prime mover generally includes a male portion secured to the prime mover and a female portion secured to the implement. Both the male portion and the female portion have spaced apart upper and lower ends which have complimentary shapes for mating engagement between. The lower end of the female portion has a pivotable locking mechanism for selectively maintaining the male portion in mating engagement with the female portion. A spring normally urges the lock mechanism into the locked position. A lever connected to the spring can be actuated to hold the locking mechanism in a second unlocked position so that the implement can be detached from the prime mover. A lug secured to the locking mechanism limits the pivotal movement of the mechanism and allows the implement to be pulled rearwardly by the prime mover.

To hitch the implement to the prime mover, the operator need only drive the prime mover towards said hitch until the upper and lower ends of said female and male assemblies matingly engage one another, at which time the locking mechanism is automatically activated. To unhitch the implement from the prime mover, the operator moves the lever on the lock mechanism so that the mechanism is held in the disengaged position and the prime mover is then backed away from said implement.

DETAILED DESCRIPTION OF THE DRAWINGS

Figure 1:
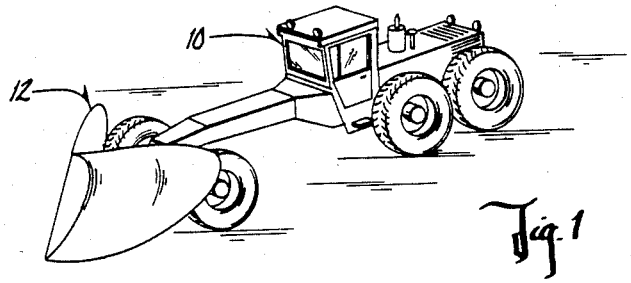
FIG. 1 is a perspective view of a road grader having a snow plow attached to the forward end thereof.
Figure 2:
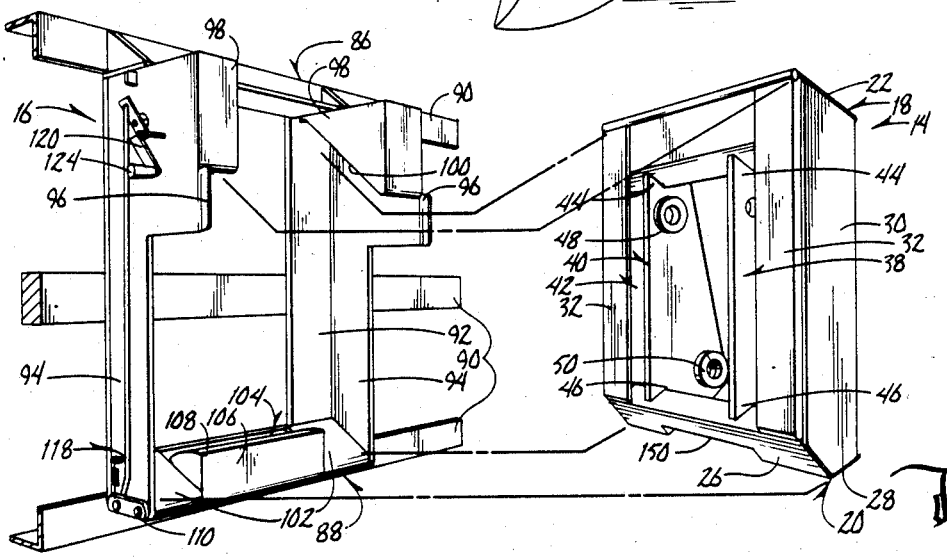
FIG. 2 is a perspective view of the female portion and a road grader male portion of the quick hitch prior to engagement therebetween.

The numeral 10 generally designates a prime mover, such as a road grader or end loader, and the numeral 12 generally designates an implement, such as a snow plow or front end scoop, attached to prime mover 10. A quick hitch is utilized in connecting implement 12 to prime mover 10.

The quick hitch of the present invention includes a male assembly 14 secured to the forward end of prime mover 10 and a female assembly 16 secured to the rearward side of implement 12. Male assembly 14 includes an upper end 18 and a lower end 20 which are a fixed distance apart. Upper end 18 includes a rearwardly downward-sloping plate 22. Lower end 20 of male assembly 14 has a forwardly upward-sloping plate 26 and a rearwardly upward-sloping plate 28. The ends of plate 22 are connected to the ends of plates 26 and 28 by side plates 30 while plates 22 and 26 are connected at their opposite ends on their forward sides by a pair of front plates 32.

A plurality of mounting plates 36, 38, 40, and 42 each have upper ends 44 and lower ends 46 which are connected to the upper end 18 and lower end 20 of male assembly 14, respectively. Each mounting plate 36, 38, 40 and 42 has a first collar 48 located near upper end 44 and a second collar 50 located near lower end 46. An opening extends through each of the mounting plates and collars. Additional brace plates 54 may be included between pairs of mounted plates 36–38 and 40–42 to provide additional structural stability therebetween.

On the forward end of prime mover 10 are an upper pair of arms 68 and 70 and a lower pair of arms 72 and 74. Cross brace 76 is provided between pairs of lower arms 72 and 74 for structural support. Each of arms 68, 70, 72 and 74 also has a collar 78 attached thereto. Each collar 78 has a hole extending through the center thereof and through the respective arm.

To connect male assembly 14 to the front end of prime mover 10, upper arm 68 fits between mounting plates 36 and 38 at upper ends 44 thereof, upper arm 70 fits between mounting plates 40 and 42 at upper ends 44 thereof, lower arm 72 fits between mounting plates 36 and 38 at lower ends 46 thereof, and lower arm 74 fits between mounting plates 40 and 42 at lower ends 46 thereof. Pin 84 extends through the aligned holes in each of the associated arms 68, 70, 72 and 74 and respective collars and mounting plates. Pin 84 is held in place in any convenient manner, such as nut and bolt assembly 85. It is understood that male assembly 14 may be connected to the front end of prime mover 10 in any convenient fashion, and the construction herein described is but one example of such an interconnection.

Female assembly 16 has an upper end 86 and a lower end 88 which are a fixed distance apart. Female assembly 16 is connected to implement 12 by a plurality of connecting members 90. A pair of spaced apart vertical butting plates 92 are attached to connecting members 90 and extend between upper end 86 and lower end 88 of female assembly 16. Side plates 94 are attached to butting plates 92 and extend rearwardly therefrom and along the length thereof. Side plates 94 each include an outwardly angled flange 96 to assist in the horizontal alignment of the male and female assemblies.

Secured to each butting plate 92 and side plate 94 at the upper end 86 of female assembly 16 is a pair of triangular members 98 each having a rearwardly downward-sloping surface 100. Fixed to each of butting plates 92 and side plate 94 at lower end 88 of female assembly 16 is a forwardly upward-sloping ramp 102.

Figure 7:
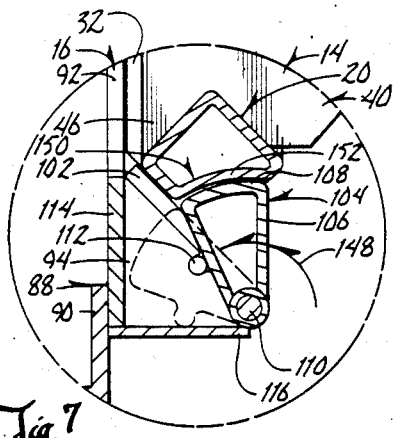
FIG. 7 is an enlarged side elevation view taken along line 7—7 of FIG. 5.

Lower end 88 of female assembly 16 also includes a locking mechanism 104. Locking mechanism 104 includes a wedge-shaped member 106 having an arcuate upper surface 108 which is pivotable on a shaft 110 journalled between opposite side plates 94. As seen in FIG. 7, member 106 is pivotable between a first locked position shown in solid lines and a second unlocked position shown in dotted lines. Member 106 is positioned between opposite ramps 102 and has a lug 112 attached at each end thereof for engagement with the bottom side of each of the ramps 102 so as to limit the pivotal movement of member 106. Lower end 88 of female assembly 16 may also include lower structural support plates 114 and 116.

Locking mechanism 104 also includes a lever control means 118 which normally urges member 106 to its first locked position but which can also maintain member 106 in its second unlocked position. Lever control means 118 comprises a lever arm 120 pivotable about pin 122 mounted on side plate 94 and a handle 124 attached to the outer end of arm 120. A first linkage arm 126 has one end 128 connected to the inner end of lever arm 120 opposite handle 124. The opposite end 130 of linkage arm 126 is connected to a second linkage arm 132 adjacent one end 134 thereof. The opposite end 136 of second linkage arm 132 is fixed to shaft 110. A spring 138 is attached at one end to end 134 of second linkage arm 132 and at the opposite end to a flange 140 mounted on side wall 94 of female assembly 16. A second flange 142 is also mounted on side plate 94 above pin 122 of lever arm 120. Spring 138 normally urges lever arm 120 to the position shown in FIG. 8 such that wedge-shaped member 106 is normally yieldably urged to the first locked position seen in solid lines in FIG. 7. Lever arm 120 can be pivoted about pin 122 in a counterclockwise direction, as indicated by arrow 144, until a portion 146 thereof engages flange 142. When lever arm 120 is so pivoted, linkage arms 126 and 132 overextend spring 138 such that lever arm 120 maintains engagement with the flange 142 whereby wedge-shaped member 106 is held in the second unlocked position. Lever arm 120 is positioned near upper end 86 of female assembly 16 so that the operator of prime mover 10 can see that locking mechanism 104 has properly locked male assembly and female assembly together in retentive engagement.

The construction of male assembly 14 and female assembly 16 permit the quick hitching of the two assemblies. To hitch the male and female assemblies together, prime mover 10 is advanced until angled plate 22 on upper end 18 of male assembly 14 moves beneath angled plate 100 on upper end 86 of female assembly 16. It is noted that flanges 96 on side plate 94 of female assembly 16 aid in the horizontal alignment of the male and female assemblies. As prime mover 10 continues to move forwardly, angled plate 26 of lower end 20 of male assembly 14 engages ramps 102 on lower end 88 of female assembly 16. As angled plate 26 moves upwardly along ramps 102, angled plate 22 on upper end 18 of male assembly 14 matingly engages sloping surface 100 of member 98. Meanwhile, wedge-shaped member 106 pivots forwardly as indicated by arrow 148 in FIG. 7. It is noted that plate 26 on lower end 20 of male assembly 14 has a recessed portion 150 with a width slightly greater than that of wedge-shaped member 106. Recessed portion 150 includes an arcuate surface 152 which has a complementary shape to arcuate surface 108 of wedge-shaped member 106. As plate 26 on lower end 20 of male assembly 14 continues to ride upwardly upon ramps 102, recessed portion 150 is presented towards wedge-shaped member 106 such that spring 138 of locking mechanism 104 urges member 106 to its locked position. These two arcuate surfaces 108 and 152 matingly engage to lock male assembly 14 in a hitched relationship with female assembly 16.

When male assembly 14 is lockingly hitched to female assembly 16, front plates 32 of male assembly 14 are adjacent butting plates 92 of female assembly 16, angled plate 22 on upper end 18 of male assembly 14 matingly engages sloping surface 100 on upper end 86 of female assembly 16, angled plate 26 on lower end 20 of male assembly 14 engages ramps 102 on lower end 88 of female assembly 16, and arcuate surface 152 in recessed portion 150 on lower end 20 of male assembly 14 matingly engages arcuate surface 108 of wedge-shaped member 106 on female assembly 16. It can be seen that male assembly 14 is thereby maintained in a locked position with regard to female assembly 16. Lugs 112 prevent wedge-shaped member 106 from pivoting beyond engagement with portion 150 of male assembly 14 and allows prime mover 10 to pull rearwardly on the attached implement 12 without unhitching the implement.

It is noted that during the hitching process, after angled plate 22 of male assembly 14 have engaged sloping surface 100 of female assembly 16, a conventional hydraulic system 154 operatively attached to prime mover 10 may be actuated to raise male assembly 14 and female assembly 16 via connecting arms 68, 70, 72 and 74 such that the center of gravity of implement 12 will cause the implement and lower end 88 of female assembly 16 to pivot rearwardly toward prime mover 10 and male assembly 14 such that wedge-shaped member 106 is more easily urged to its locked position. Hydraulic system 154 can also be employed to raise and lower implement 12 as needed during use.

Figure 8:
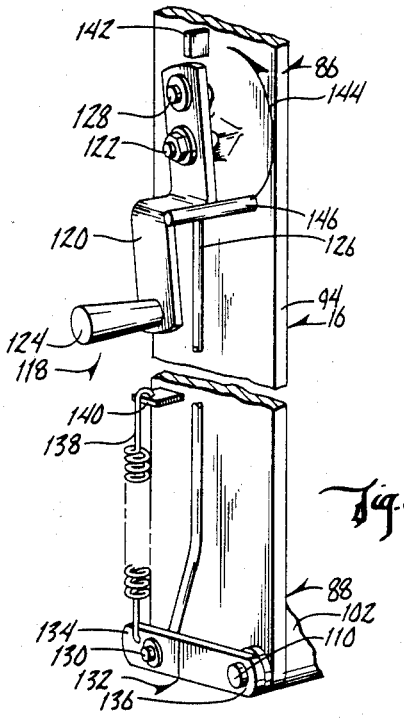
FIG. 8 is an enlarged perspective view showing the spring and lever used in moving the locking mechanism between its locked and unlocked positions.

To unhitch the two assemblies, lever ar 120 is merely pivoted about axis 122 in the direction of arrow 144, as shown in FIG. 8, such that linkage arm 132 pivots shaft 110 and attached wedge-shaped member 106 into the second unlocked position as shown in dotted lines in FIG. 7. Because spring 138 is over extended when lever arm 120 is so pivoted, member 106 will remain in the unlocked position as prime mover 10 is moved rearwardly away from implement 12. Male assembly 14 will slide downwardly upon ramps 102 until upper end 18 can be removed from upper end 86 of female assembly 16. Thus, male assembly 14 can be quickly and easily unhitched from female assembly 16.

Figure 3:
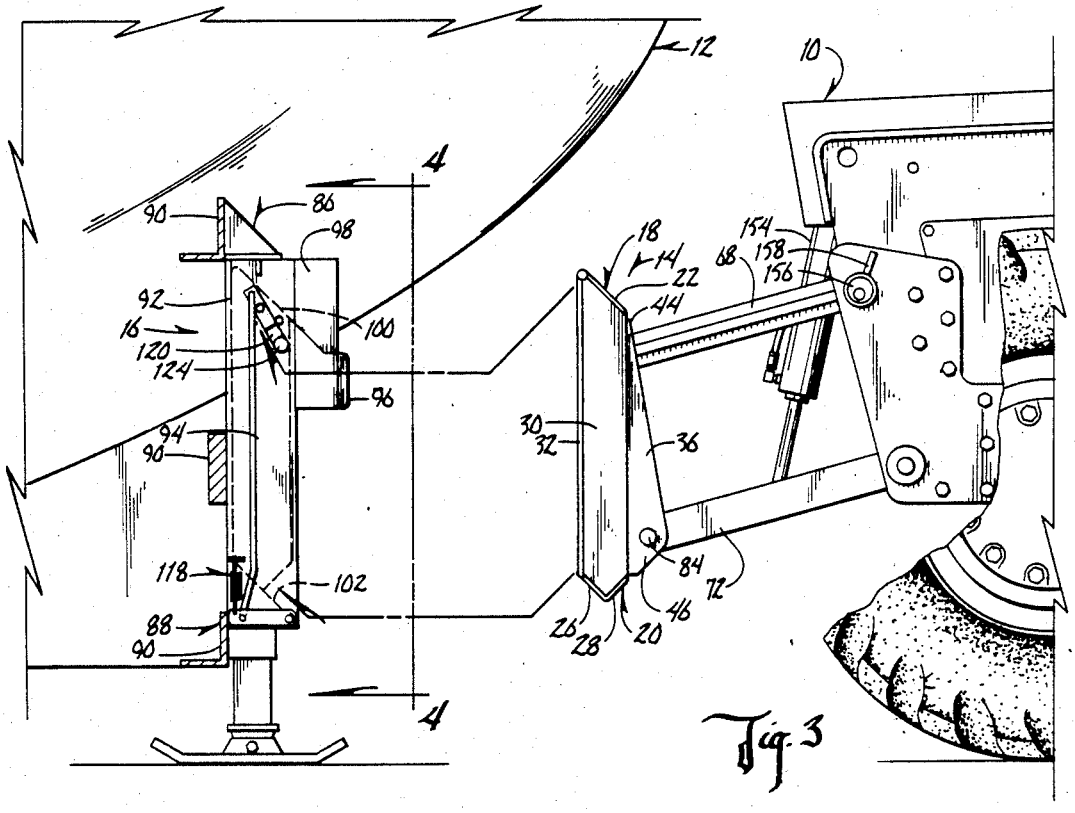
FIG. 3 is a side elevation view showing the male and female portions in a disengaged position, with dotted lines representing the engaged position of the two portions.
Figure 4:
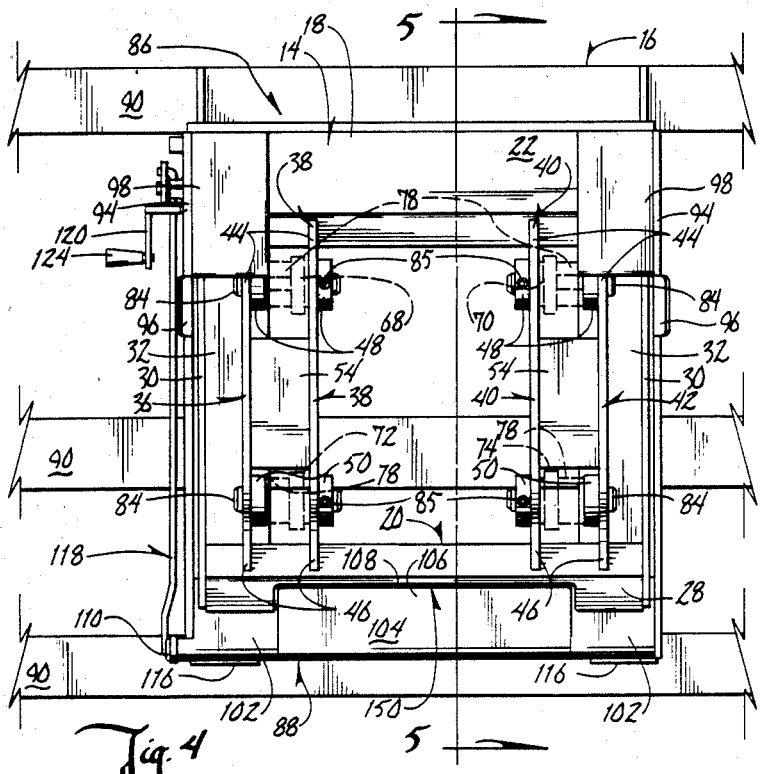
FIG. 4 is a rear elevation view of the engaged male and female portions as seen along line 4—4 of FIG. 3.
Figure 5:
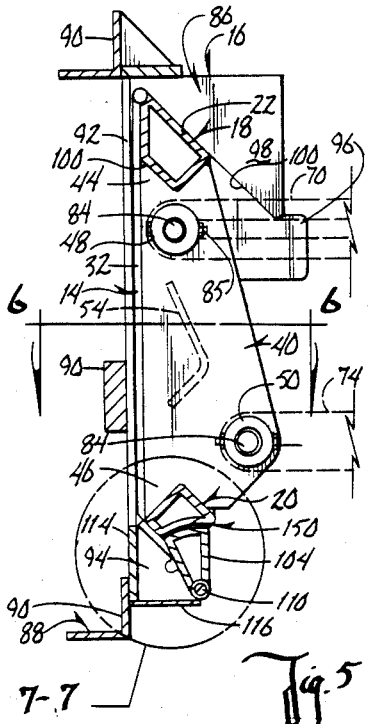
FIG. 5 is a sectional side elevation view taken along line 5—5 of FIG. 4.
Figure 6:
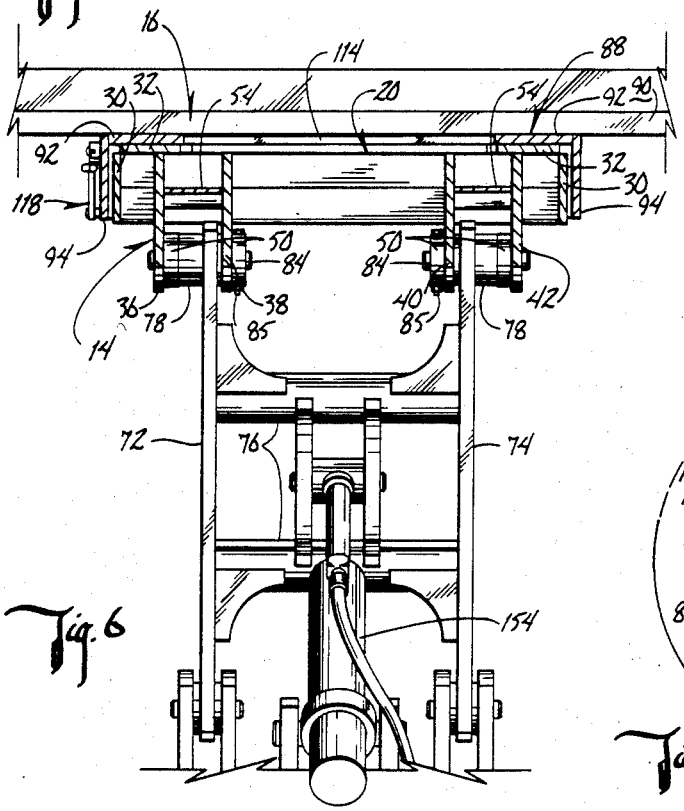
FIG. 6 is a sectional top plan view taken along line 6—6 of FIG. 5.

In order that implement 12, such as a snow plow, can be tilted to accommodate use in varying environments, such as plowing wet or dry snow, a conventional eccentric bushing 156 or the like can be provided in the connection between upper arms 68 and 70 and prime mover 10, as seen in FIG. 3. A lever arm 158 can be used to pivot such a bushing to the desired position, thus changing the angle of attack of male assembly 14 and hitched female assembly 16 with respect to the ground or road surface. Lever arm 158 can also be moved to change the position of male assembly 14 for hitching purposes in the event female assembly 16 is resting on unlevel ground.

Figure 9:
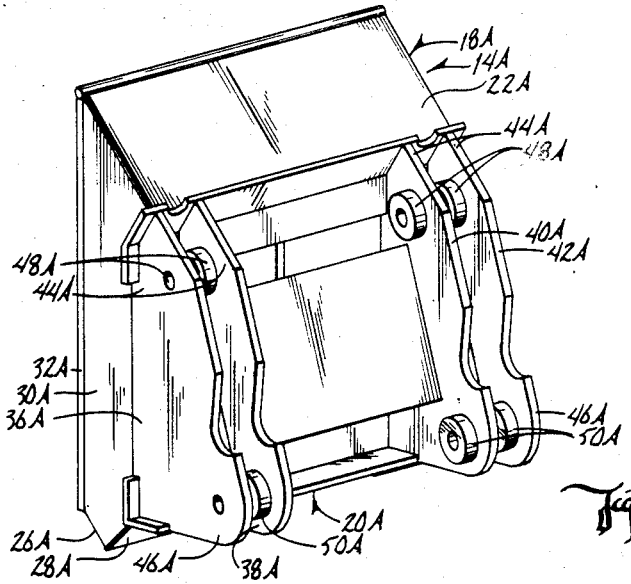
FIG. 9 is a perspective view of a male assembly used on a front end loader.

FIG. 9 shows modified male assembly 14A for use on a front end loader. The modification is merely in the means employed in connecting male assembly 14A to the front end loader. Male assembly 14A includes mounting plates 36A, 38A, 40A and 42A each having upper ends 44A and lower ends 46A which are connected to upper end 18A and lower end 20A of male assembly 14A, respectively. Each mounting plate has a first collar 48A connected located near upper end 44A and a second collar 50A located adjacent lower end 46A. An opening 52A extends through each of the mounting plates and collars. The connection of male assembly 14A to an end loader is identical to the connection previously described with respect to lower arms 72 and 74 of prime mover 10. The hitching and unhitching of male assembly 14A to female assembly 16 is also identical to that previously described. The modification of male assembly 14A with respect to male assembly 14 is necessary due to the difference in the connecting arms 68, 70, 72 and 74 of a road grader and an end loader.

Hitching the implement to the prime mover can thus be accomplished without requiring the operator to leave or get out of the prime mover. Similarly, once lever arm 120 is pivoted to hold wedge-shaped member in its unlocked position, the operator need not leave his operating position on the prime mover to unhitch the implement from the prime mover.

It can be seen from the above description that the present invention provides a quick and easy means of hitching and unhitching the male and female assemblies of a prime mover and an implement to be connected thereto.

What is claimed is:

1. A quick hitch assembly for attaching an implement to a prime move, comprising:

a male portion secured to said prime mover and having spaced apart upper and lower members, and opposite sides, with a convave surface in said lower member, and a female portion secured to said implement and having spaced apart upper and lower members, and opposite sides, said upper and lower members of said male and female portions having complimentary shapes for mating engagement therebetween;

said female portion including a releasable locking means on said lower end thereof for selectively coupling said male and female portions together;

said locking means including a lock member pivotal between a first locked position and second unlocked position, said lock member comprising an elongated tubular member having a cross-sectional shape in the form of a sector of a circle having an outer convex surface and an opposite inner portion, said lock member being pivotally connected at said inner portion to said lower member of said female portion, said outer convex surface of said lock member matingly engaging said concave surface in said lower member of said male portion so as to couple said male and female portions together.

2. The quick hitch assembly of claim 1 wherein said locking means further includes a lever for moving said lock member between said first and second positions.

3. The quick hitch assembly of claim 1 wherein said locking means further includes a resilient means for normally yieldably urging said lock member into said first position.

4. The quick hitch assembly of claim 3 wherein said resilient means is a spring.

5. The quick hitch assembly of claim 1 further comprising horizontal guide means for horizontal alignment of said male and female portions.

6. The quick hitch assembly of claim 5 wherein said horizontal guide means are a pair of oppositely disposed flanges secured to said female portion.

7. The quick hitch assembly of claim 1 wherein said upper and lower members of said male portion are in fixed spaced relation to one another.

8. The quick hitch assembly of claim 1 further comprising vertical guide means for guiding said male and female portions into said locked position.

9. The guick hitch assembly of claim 8 wherein said vertical guide means includes an incined ramp adjacent said lower member of said female portion upon which said lower members of said male portion moves.

10. The quick hitch assembly of claim 8 wherein said vertical guide means includes an inclined surface on said lower member of said male portion for engaging said lower member of said female portion.

11. The quick hitch assembly of claim 1 wherein said concave surface in said lower member of said male portion is centrally located with respect to said opposite sides thereof and extends substantially across the width thereof, and said convex surface of said locking member on said female portion is centrally located with respect to said opposite sides and extends substantially across the width thereof.

12. The quick hitch assembly of claim 1 wherein the radius of curvature of said concave and convex surfaces are substantially equal.

13. The quick hitch assembly of claim 1 wherein said locking member pivots in one direction to permit coupling and uncoupling said male and female portions, and said locking member pivots in an opposite direction to said one direction such that said concave and convex surfaces matingly engage one another and thereby lock said male and female portions together.

14. The quick hitch assembly of cliam 13 further including means for limiting the pivotal movement of said locking member in said opposite direction such that said convex and concave surfaces will not disengage when said locking member pivots in said opposite direction.

* * * * *